US006328593B1

(12) United States Patent
Chang et al.

(10) Patent No.: US 6,328,593 B1
(45) Date of Patent: Dec. 11, 2001

(54) SET OF FANCY LAMP BULB AND SOCKET ADAPTOR

(76) Inventors: Chu-Chen Chang; Zheng-Xian Chang; Zheng-Dao Chang, all of No. 12, Lane 96, Nan Chung Street, Hsinchu City (TW)

( * ) Notice: Subject to any disclaimer, the term of this patent is extended or adjusted under 35 U.S.C. 154(b) by 0 days.

(21) Appl. No.: 09/685,210

(22) Filed: Oct. 11, 2000

(51) Int. Cl.[7] ..... H01R 4/24
(52) U.S. Cl. ..... 439/419; 362/249
(58) Field of Search ..... 439/419, 611, 439/612, 699.2, 699.1, 375, 662; 362/249, 392

(56) References Cited

U.S. PATENT DOCUMENTS 5,800,212 * 9/1998 Hsu ..... 439/612
6,079,848 * 6/2000 Ahroni ..... 439/611

* cited by examiner

*Primary Examiner*—Brian Sircus
*Assistant Examiner*—Phuong KT Dinh
(74) *Attorney, Agent, or Firm*—Rosenberg, Klein & Lee

(57) ABSTRACT

A decorative lamp bulb and socket adapter is provided without a conventional fixed sleeve. The assembly takes advantage of contact surfaces of the sealing lug at the bottom of the bulb, a top surface of the sealing socket and the bottom surface of the bottom edge of the bulb. The lapped surfaces in both horizontal and vertical directions form a solid sealing structure to prevent water from permeating into the inside of the socket adapter. By clamping the terminal portion of the bulb with the clamping portion of the conducting strips, the connection between the electrodes at the terminal portion of the bulb and the clamping portions of the conducting strips is maintained.

3 Claims, 6 Drawing Sheets

SET OF FANCY LAMP BULB AND SOCKET ADAPTOR

BACKGROUND OF THE INVENTION

1. Field of the Invention

The present invention relates to a set of fancy-lamp bulb and socket adapter, and more particularly to a set of fancy-lamp bulb and socket adapter without conventional fixed sleeve.

2. Description of Prior Art

In accordance with the conventional fancy-lamp bulb and socket adapter (as shown on FIG. 6), a fixed sleeve 52 is put on the bottom of the Christmas-lamp bulb for retaining the bulb and fixing the cords 53 leading out from the two electrodes of the bulb 51 by stretching out the cords 53 and banding back, then plug the assembly of the bulb 51 and the fixed sleeve 52 into the socket adapter 54 so that the fixed sleeve 52 fit into the socket adapter 54 tightly, and simultaneously the cords 53 leading out from the two electrodes of the bulb 51 contact with the conductors (not shown) at inside of the socket adapter 54.

In this mechanism, the fixed sleeve 52 is used for stiffening the long stem Christmas-lamp bulb 51, and keeping the smooth contact between the cords 53 of the terminals of bulb 51 and the conductors of the socket adapter 54.

On the other regard, the fixed sleeve 52 can enhance the water proof function between the bulb 51 and the socket adapter 54 so as to prevent the water from entering in and piling up in the inside of the socket adapter 54 to bring up short circuit between the both terminals.

If the joint between the bulb and the socket adapter has sealing and locating functions, and the conductors is kept in steady contact with the cords at the bulb bottom, the fixed sleeve can be omitted so as to save component and assembling cost.

OBJECTS AND SUMMARY OF THE INVENTION

It is therefore a main object of the present invention to provide a set of fancy lamp bulb and socket adapter without fixed sleeve, and simultaneously have well waterproof and locating functions, and steady conduction contact between the fancy-lamp bulb and the socket adapter.

This object is achieved by a set of fancy-lamp bulb and socket adapter, in which the bulb has a flat edge at the bottom side, and extends a sealing lug from the center of the bottom to downward, and a terminal portion is extended from the sealing block bottom, and two electrodes cover on the both end of the terminal portion separately; the socket adapter has a sealing socket at the neck portion, and a key embedding groove grooved on the bottom of the sealing socket; the conducting strip has a sharp bottom, and an elastic clamping upper portion for locating in the locating hole of the key groove; by means of touching surfaces of the sealing lug at the bottom of the bulb, top surface and the sealing socket and the bottom surface of the sealing socket of the socket adapter, the lapping surfaces appear into horizontal and vertical three dimensions change to form a solid sealing structure.

If water would permeate into the inside of the socket adapter, first it will be blocked by the couple of touching surfaces of the bottom side of the bulb and the top rim surface of the socket adapter horizontally, then it will meet the block coming from the vertical touching surfaces between the sealing lug and the sealing socket, so the sealing effect of this mechanism is increased obviously.

On the other regard, when the bulb is embedded into the socket adapter, the terminal portion of the bulb is inserted into the key groove, and clamped by the clamping upper portion of the conducting strip tightly so that the two electrodes and the conducting strips are kept in a steady contact.

DETAILED DESCRIPTION OF PREFERRED EMBODIMENTS

Figure 1:
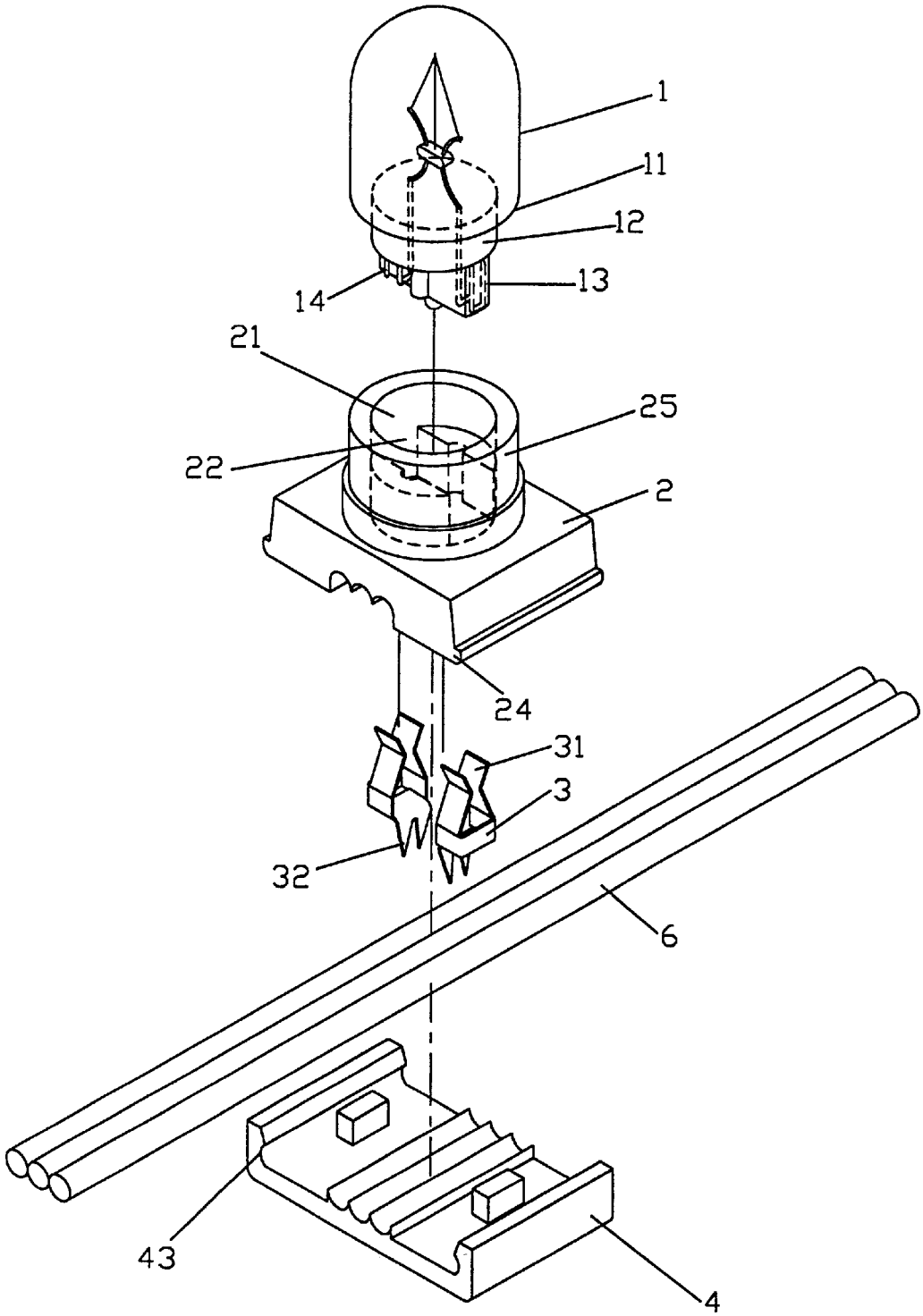
FIG. 1 is an exploded view of the present invention.
Figure 2:
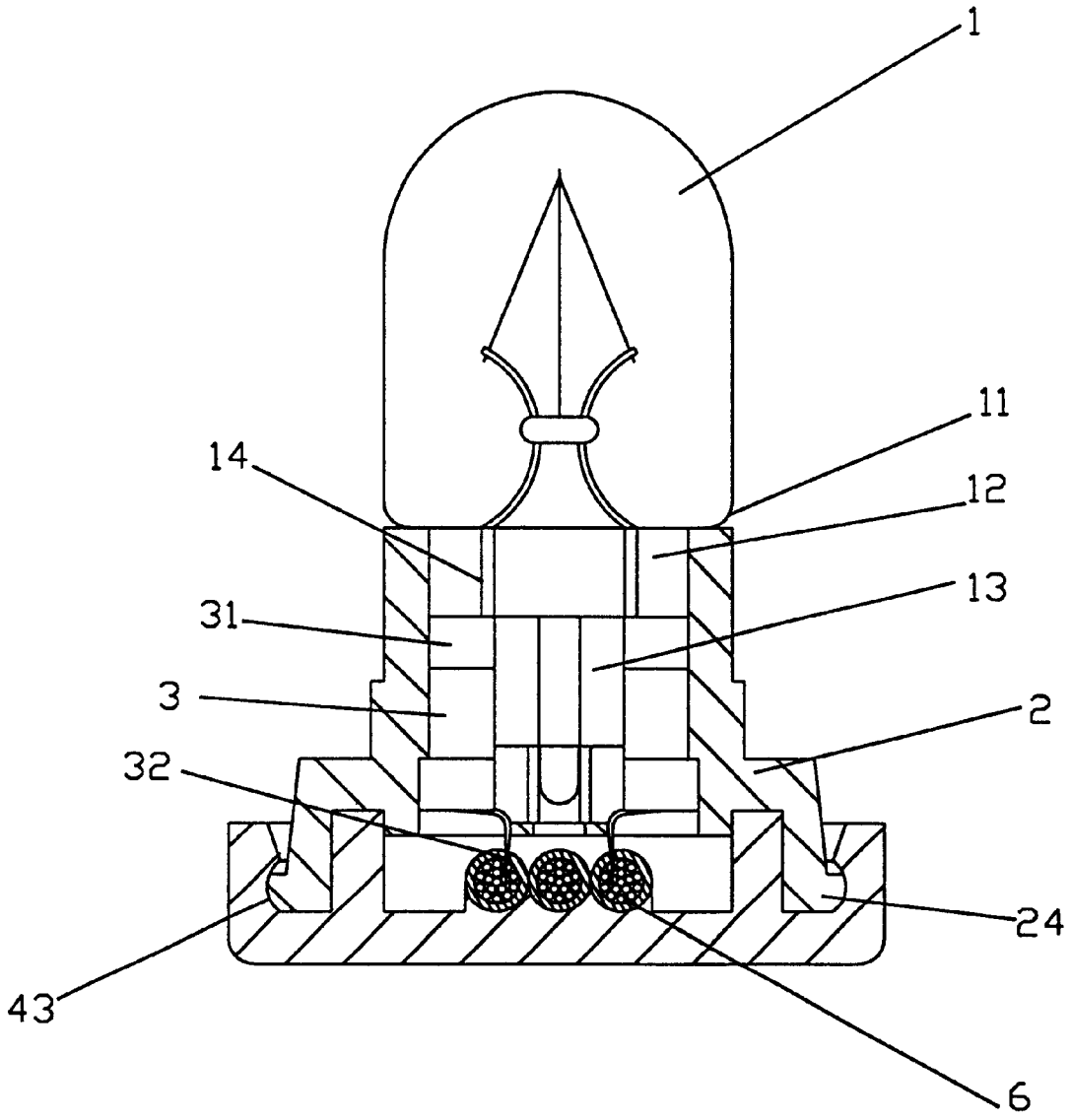
FIG. 2 is a cross-section view showing combining state of the present invention.

Referring to FIG. 1 and FIG. 2, the present invention is consisted of a bulb 1, a socket adapter 2, a pare of conducting strips 3, cords 6 and a joining seat 4, wherein:

The bulb 1 has a level flat bottom edge 11 retracted inward to the center, and a sealing lug 12 extended to the downward from the bottom center co-ordinating to the sealing socket 21 of the socket adapter 2, and a terminal portion 13 extended to the downward from the bottom of the sealing lug 12, co-ordinating to the key embedding groove 22 of the socket adapter 2, covered with two electrodes 14 connecting with the both end of the filament of the bulb 1.

The socket adapter 2 has a neck portion 25 with a diameter being a bit smaller than the bottom edge 11 of the bulb 1, and a sealing socket 21 co-ordinating to the sealing lug 12 of the bulb 1 in shape and space size, and a key embedding groove 22 grooved on the bottom of the sealing socket 21 in downward again coordinating to the terminal portion 13 of the bulb 1 in shape and space size, and two locating holes 26 formed on the bottom portion of the key embedding groove 22 for locating two conducting strips 3 (referring to FIG. 3), and two locating bars 24 formed on the both outside bottom edges separately for locking with the joining seat 4.

Figure 3:
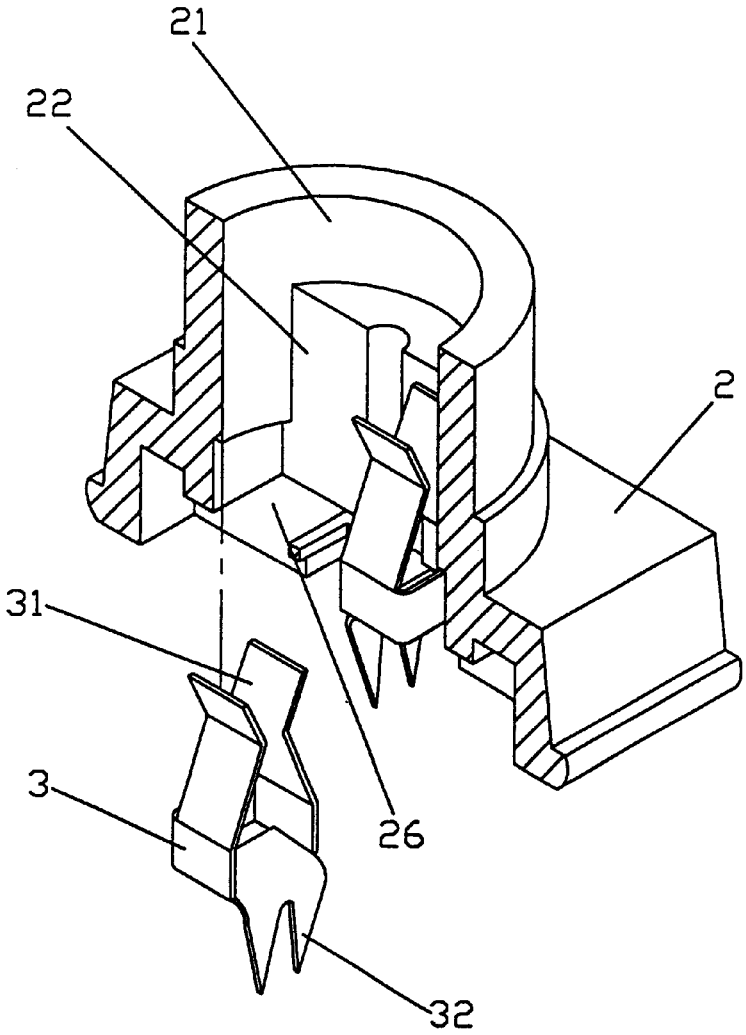
FIG. 3 is a cross-section solid view showing assembling state of the socket adapter and the conducting strip of the present invention.
Figure 4:
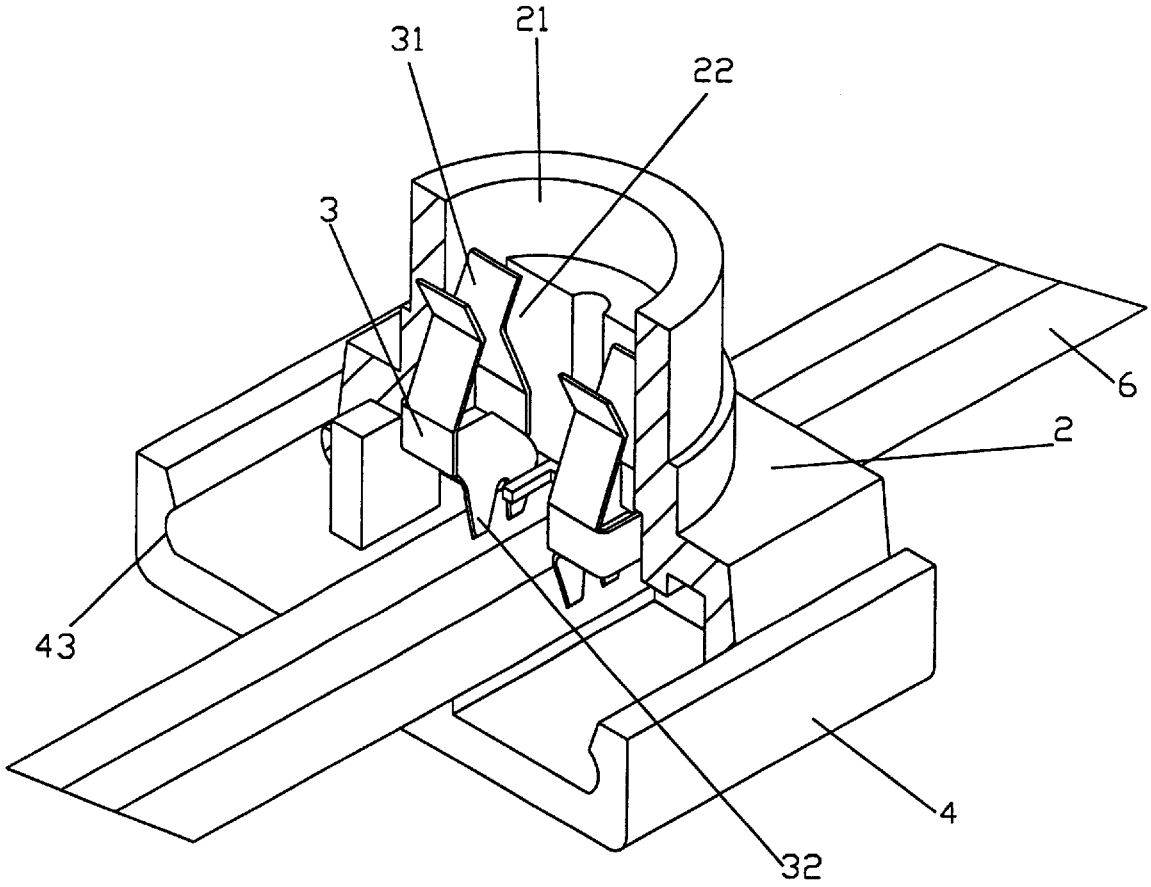
FIG. 4 is a cross-section solid view showing the assembling relationship of the socket adapter and the joining seat of the present invention.

As shown on FIG. 3 and FIG. 4, the conducting strip 3 has a sharp bottom portion 32 for piercing the insulating barrier of the cord 6, and elastic clamping upper portion 31 for clamping the terminal portion 13 of the bulb 1. And said conducting strip 3 can be pre-attached on the hollow locating holes 26 of the key embedding groove 22 so that the clamping upper portion 31 stretches into the inside of the key embedding groove 22, and the sharp bottom portion 32 exposed out the bottom side of the socket adapter 2 exactly on the piercing cord position as assembling with the joining seat 4.

In combination, plug the bulb 1 into the socket adapter 2 so that the sealing lug 12 and the terminal portion 13 of the bulb 1 embed into the sealing socket 21 and the key embedding groove 22 of the socket adapter 2, then put the cords 6 within the joint seat 4, finally by means of locating bars 24 of the socket adapter 2 and locating slot 43 of joint seat 4, the assembly of the bulb 1 and the socket adapter 2 is fixed on the cords 6 with the joining seat 4, simultaneously the terminal portion 13 of the bulb 1 inserts into the clamping upper portions 31 of the conducting strips so that the electrodes 14 on the terminal portion 13 of the bulb 1 keeps in steady contact with the elastic clamping upper portion 31, on the other side, the sharp bottom portions 32 of the conducting strips pierce the insulating barrier of the cords to connect to the power source.

Figure 5:
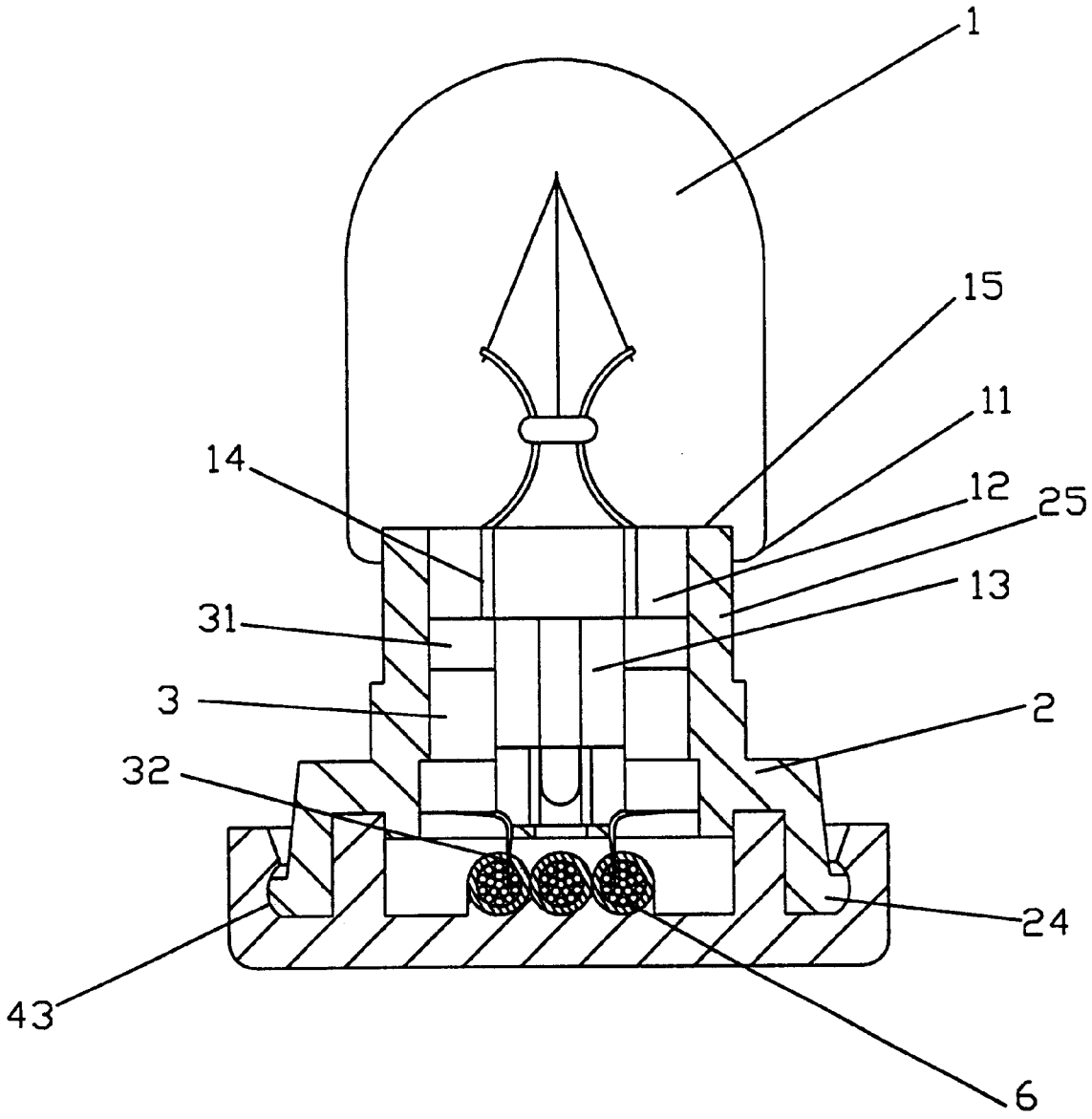
FIG. 5 is a cross-section view showing the second operation of the present invention.
Figure 6:
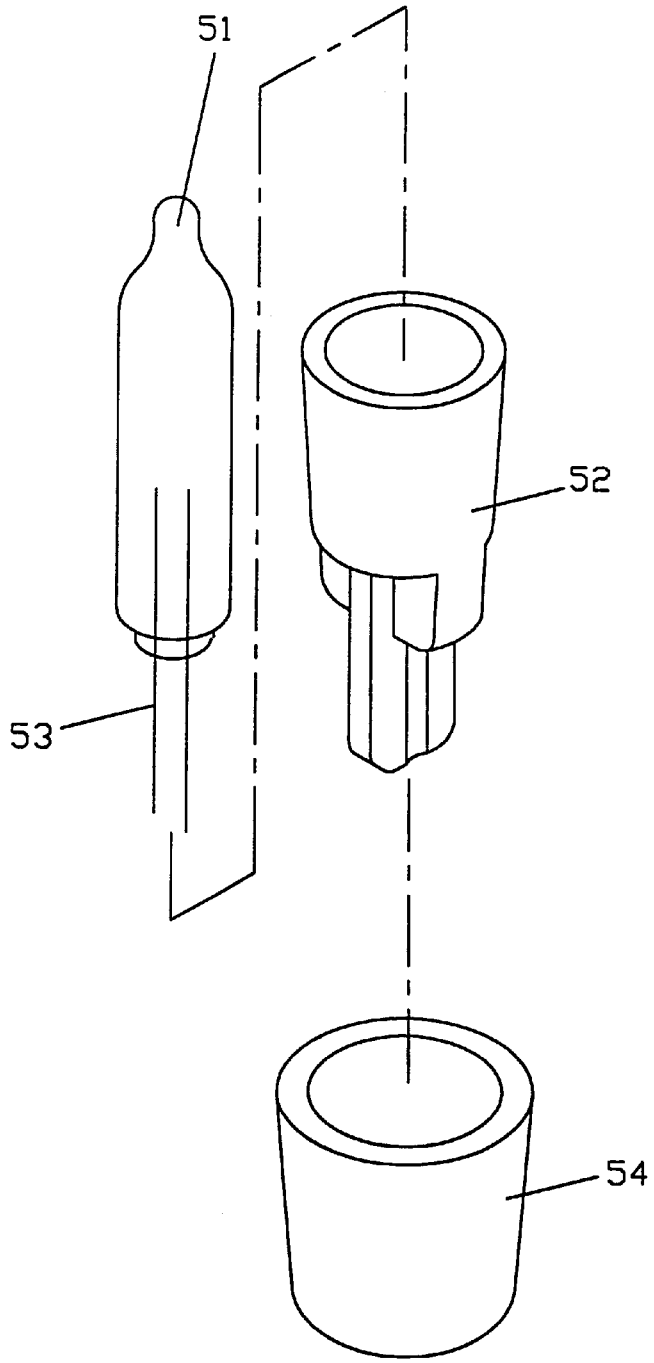
Prior Art FIG. 6
FIG. 6 is a prior art of the conventional Christmas-lamp socket.

The FIG. 5 shows the another operation of the present invention, wherein the main difference from the above operation is that the bulb 1 has a ring groove 15 on inside of the flat bottom edge 11 for the neck portion 25 of the socket adapter 2 fitting in, thereby to increase the touching surface between the bulb 1 and the socket adapter 2 further to improve the sealing effect.

What is claimed is:

1. A decorative lamp bulb and socket adapter, comprising a bulb, a socket adapter, a pair of conducting strips, electrical wires and a joining seat;

said bulb having a level flat bottom edge extending inwardly toward a center of said bulb, said bulb having a downwardly extending sealing lug and a terminal portion extending downwardly from a bottom of said sealing lug, said bulb having a pair of electrodes covering respective portions of said terminal portion;

said socket adapter having a neck portion with a diameter being smaller than a diameter of the bottom edge of the bulb, and a sealing socket cooperating with the sealing lug of the bulb in both shape and size, said socket adapter having a key embedding groove formed in a bottom of the sealing socket in correspondence with the terminal portion of the bulb in both shape and size, said socket adapter having two locating holes formed in a bottom portion of the key embedding groove and two conducting strips respectively located in said locating holes; and, each said conducting strip having a sharp bottom portion and an elastic upper clamping portion, each said conducting strip being respectively located in the hollow locating holes in the key embedding groove so that the clamping portion extends into the key embedding groove, the sharp bottom portion of each said conducting strip extending out from a bottom side of the socket adapter for piercing a predetermined position of a respective one of the electrical wires when said socket adapter is assembled to the joining seat.

2. The decorative lamp bulb and socket adapter as claimed in claim 1, wherein said socket adapter has a pair of locating bars formed on opposing sides thereof adjacent the bottom side of the socket adapter, said joining seat having a pair of locating slots for respective engagement with said locating bars.

3. The decorative lamp bulb and socket adapter as claimed in claim 1, wherein said bulb has a ring groove formed in the flat bottom edge thereof for the neck portion of the socket adapter to fit therein.

* * * * *